United States Patent [19]

Garbell

[11] 4,328,650

[45] May 11, 1982

[54] VENTILATED SOUND BARRIER FOR WINDOW OPENINGS

[76] Inventor: Maurice A. Garbell, P.O. Box 948, San Francisco, Calif. 94104

[21] Appl. No.: 137,514

[22] Filed: Apr. 4, 1980

[51] Int. Cl.[3] ..... E04B 1/82; E04F 17/04

[52] U.S. Cl. ..... 52/202; 98/88 R; 181/224; 52/144

[58] Field of Search ..... 181/224, 225, 289, 295; 52/19, 144, 202, 203; 49/61; 98/88 R

[56] References Cited

U.S. PATENT DOCUMENTS

| | | | |
|---|---|---|---|
| 477,876 | 6/1892 | Webber | 52/19 |
| 1,995,819 | 3/1935 | Rogers | 52/144 |
| 3,085,647 | 4/1963 | Jenn | 181/224 |
| 3,537,544 | 11/1970 | King | 181/225 |
| 4,132,159 | 1/1979 | Dellrad | 181/224 |

*Primary Examiner*—Price C. Faw, Jr.
*Assistant Examiner*—Henry E. Raduazo
*Attorney, Agent, or Firm*—Ernest M. Anderson

[57] ABSTRACT

A sound barrier is provided for use in front of a building opening, such as a sliding or inwardly hinged window. The sound barrier comprises a substantially planar panel and a frame formed with elongate members, each member having a channel opening. A barrier member mounted circumferentially of the building opening is received within the channel opening of each frame member but in spaced relation thereto. The barrier member cooperates with the frame and the combination defines a tortuous passageway that permits the passage of air but interferes with the transmission of sound.

2 Claims, 4 Drawing Figures

VENTILATED SOUND BARRIER FOR WINDOW OPENINGS

SUMMARY OF THE INVENTION

This invention relates generally to the attenuation of sound while permitting ventilation and the passage of air into an enclosure. The problems of sound or noise penetration are particularly severe in residential communities adjacent to roads, railroads, airports and industrial parks. Conventional sliding windows or glass doors, left open for ventilation, permit the noises of traffic, trains, airplanes and the like to enter. This fact is well recognized and in many residential areas where such noises are prevalent, sliding windows and glass doors are equipped with extra thick or multi-layered panels capable of reducing sound so long as the panels remain closed. However, during summer months or in regions where the air temperatures are exceedingly high throughout the year, it is often necessary to rely on central forced air ventilation, and the doors and windows remain closed.

The operation of central, forced air ventilation systems is energy consuming and may itself produce objectionable blower noises. Thus, in residential communities many people prefer to open their windows notwithstanding the existence of exterior noises. It is recognized that even small apertures or gaps between a sliding panel and its complimentary stop or jamb result in an appreciable increase in the interior noise levels attributable to exterior noises.

The drawbacks characteristic of conventional jambs, sliding doors and windows, as well as other types of windows and doors, have been recognized by others and various kinds of sound baffling devices have been created. Exemplary teachings of the prior art as related to this invention are disclosed in U.S. Pat. Nos. 1,108,613, 1,611,483, 1,990,520 and 2,225,809.

In brief, the present invention teaches the construction of a novel sound barrier that may be utilized in connection with an existing aperture such as a window that forms part of an existing structure. The sound barrier comprises a substantially planar panel (preferably transparent) having a frame comprised of elongated channel members. Each channel member defines a U-shaped opening that is open from one side of the panel. A complementary barrier member is affixed to the building, said member extending circumferentially of the opening to the building. The barrier member is received within the U-shaped opening of each of said channel members, but spaced therefrom to permit the passage of air through a tortuous passageway. Means are also provided for mounting the sound barrier panel and frame in front of the opening to the building and to maintain a spacing between the barrier member and the openings of the channel members. The barrier member is received within the U-shaped openings of such channel members a distance at least one and one-half times the lateral gap spacing between the barrier member and the sidewalls of the channel openings. In addition, the surfaces of the frame members within the channel openings are preferably formed of an acoustical material which absorbs and deadens sound.

A primary object of the present invention is to provide a novel sound barrier that may be used in connection with existing buildings and disposed in front of openings thereto as to interrupt and attenuate sound waves.

Other objects of this invention will become apparent in view of the following detailed description.

In the drawings forming a part of this application and in which like parts are identified by like numerals;

Figure 1:
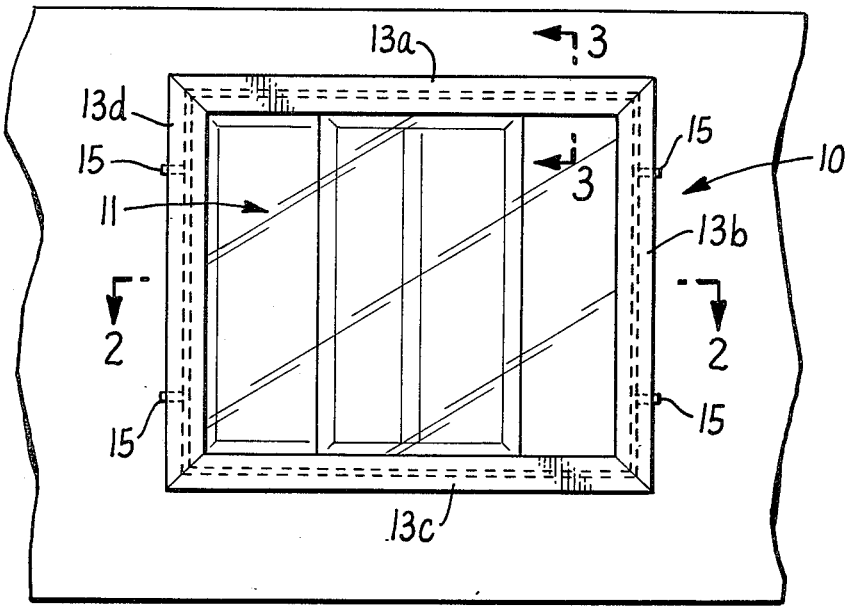
FIG. 1 is an elevation of one portion of a wall including a conventional sliding window mounted in a frame and having disposed in front thereof a preferred embodiment of this invention in a ventilated sound barrier.
Figure 2:
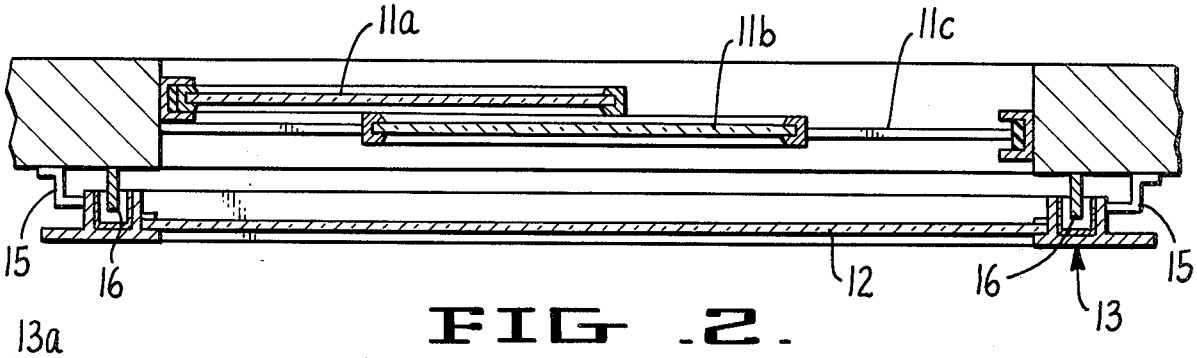
FIG. 2 is a transverse horizontal section taken on the line 2—2 of FIG. 1.

Referring to FIGS. 1 and 2 of the drawings, there is shown a wall 10 including a window 11 having a fixed panel 11*a* and a sliding panel 11*b*. Panel 11*b* is mounted between a pair of guide rails 11*c* and 11*d*, allowing the panel to be slid horizontally in front of or behind panel 11*a* (depending on the side from which the window is viewed). It will be evident that this window construction is typical of sliding windows presently utilized in the construction of many houses.

The present invention is more particularly concerned with providing a sound barrier in front of the window 11. Such a sound barrier comprises a substantially planar, transparent or opaque panel 12 circumscribed and enclosed by a frame 13, said frame comprising elongated channel member 13*a*, 13*b*, 13*c* and 13*d*. Each channel member defines a U-shaped opening 14 and each opening faces toward the wall 10 of the building. Means such as brackets 15 are utilized to mount the sound barrier in front of window 11.

A sound barrier member 16 affixed to wall 10 and projecting horizontally therefrom extends circumferentially of window 11. Barrier member 16 is received within the U-shaped openings of frame 13 but spaced therefrom to permit the passage of air through a tortuous passageway.

Figure 3:
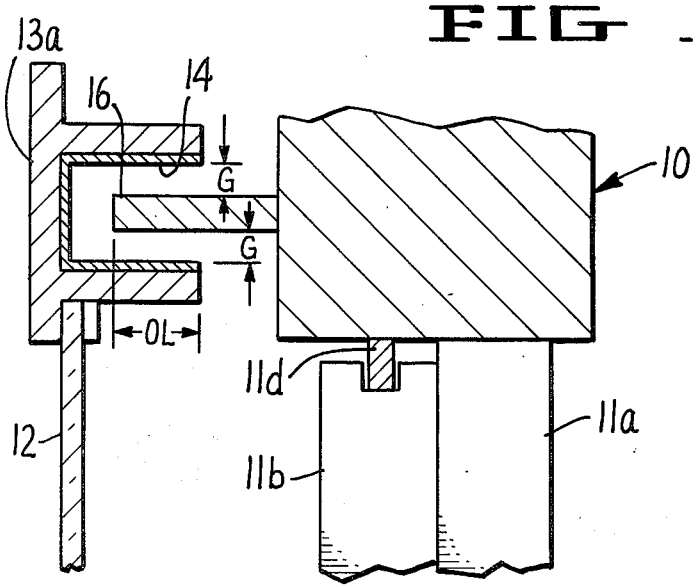
FIG. 3 is an enlarged section taken on the line 3—3 of FIG. 1.

Referring to FIG. 3, the spaced distances between barrier member 16 and the sidewalls of openings 14 provide transverse gaps G sufficient to ensure adequate air ventilation. The lateral extension of barrier 16 into channel openings 14 is designed to provide an overlap distance OL such that the distance OL equals at least one and one-half times the distance G; and the gap spacing G may be one inch or less. The spacing G (and the other spacings which define an interior passageway through the channel members) is selected to assure adequate air ventilation around barrier member 16.

Figure 4:
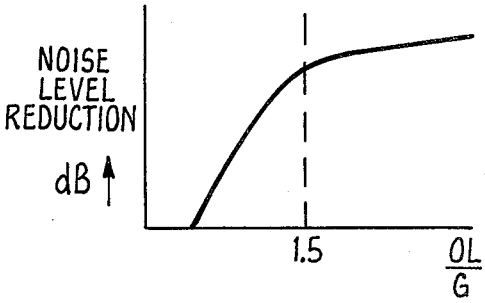
FIG. 4 is a graph illustrating the level of noise reduction which has been determined based on the dimensional relationship shown in FIG. 3.

FIG. 4 illustrates a graph based upon empirical date obtained by varying the overlap distance OL relative to the gap spacing G. It has been observed that the noise level reduction rapidly increases as the ratio OL:G increases from 0.5 to 1.5. At OL:G ratios exceeding 1.5, the noise level reduction is increased but at a decreasing rate. Thus, the use of OL:G ratios 1.5 or greater optimize noise level reduction for a given degree of ventilation capability.

In the preferred embodiment shown, the interior faces of U-shaped openings 14 are lined with a sound absorbing acoustical material such as a fiberglass or vinyl. The surfaces of barrier member 16 may be lined similarly for more effective noise reduction.

Although a preferred embodiment of the invention has been illustrated and described, various modifications and changes may be resorted to without departing from the spirit of the invention or the scope of the appended claims, and each of such modifications and changes is contemplated.

What is claimed is:

1. A ventilated sound barrier for passing air through an opening of a building while impeding the passage of sound waves, said barrier comprising a substantially planar panel circumscribed by a frame formed of channel members having side walls which define U-shaped openings to one side of said panel; a barrier member affixed to the building and extending circumferentially of said opening therein; and means mounting said panel and frame in front of the opening, said barrier being projected into the U-shaped openings of said channel members but spaced therefrom to permit the passage of air around said barrier member through a tortuous passageway, said barrier member being received within the U-shaped openings a distance at least one and one-half times the distance from said barrier member to either side wall of said channel members.

2. The sound barrier of claim 1, and further wherein the surfaces of said frame members within the channel openings are lined with acoustical material.

* * * * *